US011721474B2

(12) United States Patent
Jung et al.

(10) Patent No.: US 11,721,474 B2
(45) Date of Patent: Aug. 8, 2023

(54) COIL ELECTRONIC COMPONENT

(71) Applicant: SAMSUNG ELECTRO-MECHANICS CO., LTD., Suwon-si (KR)

(72) Inventors: Jung Hyuk Jung, Suwon-si (KR); Yu Jong Kim, Suwon-si (KR); Young Sun Kim, Suwon-si (KR); Dong Seob Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 636 days.

(21) Appl. No.: 16/592,593

(22) Filed: Oct. 3, 2019

(65) Prior Publication Data

US 2020/0185143 A1 Jun. 11, 2020

(30) Foreign Application Priority Data

Dec. 10, 2018 (KR) ..... 10-2018-0158397

(51) Int. Cl.

| | |
|---|---|
| ***H01F 27/28*** | (2006.01) |
| ***H01F 27/29*** | (2006.01) |
| ***H01F 41/04*** | (2006.01) |
| ***H01F 27/02*** | (2006.01) |

(52) U.S. Cl.

CPC ..... *H01F 27/2804* (2013.01); *H01F 27/022* (2013.01); *H01F 27/29* (2013.01); *H01F 41/041* (2013.01); *H01F 2027/2809* (2013.01)

(58) Field of Classification Search

CPC ..... H01F 27/2804; H01F 2027/2809; H01F 17/0013; H01F 17/0006; H01F 5/003; H01F 27/29; H01F 27/292; H01F 27/022

USPC ..... 336/200, 232

See application file for complete search history.

(56) References Cited

U.S. PATENT DOCUMENTS

| | | | | |
|---|---|---|---|---|
| 6,452,473 | B1 * | 9/2002 | Suzuki | H01F 17/0013 336/200 |
| 2009/0160018 | A1 * | 6/2009 | Nabeshima | H01L 23/5227 257/E27.001 |
| 2009/0293260 | A1 * | 12/2009 | Lee | H01F 41/041 335/299 |
| 2017/0178798 | A1 * | 6/2017 | Yoon | H01F 17/0013 |

(Continued)

FOREIGN PATENT DOCUMENTS

| | | | |
|---|---|---|---|
| JP | 2011014709 A | * | 1/2011 |
| JP | 2015-126199 A | | 7/2015 |

(Continued)

*Primary Examiner* — Tszfung J Chan

(74) *Attorney, Agent, or Firm* — Morgan, Lewis & Bockius LLP

(57) ABSTRACT

A coil electronic component includes a support substrate, a coil pattern disposed on at least one surface of the support substrate, and a lead-out pattern disposed on at least one surface of the support substrate and connected to the coil pattern. An encapsulant encapsulates at least portions of the support substrate, the coil pattern, and the lead-out pattern, and at least one protrusion protrudes from one side surface of the coil pattern. External electrodes are disposed externally on the encapsulant and connected to the lead-out pattern. The lead-out pattern is configured to extend in a thickness direction of the support substrate and to cover a side surface of the support substrate.

20 Claims, 7 Drawing Sheets

(56) References Cited

U.S. PATENT DOCUMENTS

| | | | | |
|---|---|---|---|---|
| 2017/0194089 | A1* | 7/2017 | Jang | H01F 27/29 |
| 2018/0358169 | A1* | 12/2018 | Nishikawa | H01F 27/292 |
| 2019/0035534 | A1* | 1/2019 | Suzuki | H01F 41/043 |
| 2019/0115143 | A1* | 4/2019 | Tachibana | H01F 27/292 |

FOREIGN PATENT DOCUMENTS

| | | | | |
|---|---|---|---|---|
| KR | 20170097883 | A | * | 8/2017 |
| KR | 10-2017-0118647 | A | | 10/2017 |

* cited by examiner

COIL ELECTRONIC COMPONENT

CROSS-REFERENCE TO RELATED APPLICATION(S)

This application claims benefit of priority to Korean Patent Application No. 10-2018-0158397 filed on Dec. 10, 2018 in the Korean Intellectual Property Office, the disclosure of which is incorporated herein by reference in its entirety.

BACKGROUND

1. Field

The present disclosure relates to a coil electronic component.

2. Description of Related Art

As electronic devices such as digital televisions, mobile phones, laptops, and the like, have been designed to have reduced sizes, efforts have been made to reduce sizes of coil electronic components provided in such electronic devices. To meet such demand, a large amount of studies into developing various types of coil-type or thin-film type coil electronic components have been conducted.

An important consideration in developing a coil electronic component having a reduced size is to implement the same properties as before after reducing a size of a coil electronic component. To this end, it may be necessary to increase a content of a magnetic material filling a core. However, there may be a limitation in increasing a content of the magnetic material due to strength of an inductor body, changes in frequency properties caused by insulating property, and for other reasons.

There have been continuous attempts to further reduce a thickness of a chip including a coil electronic component as a set, such as through innovative designs having complex structures, multifunctionality, reduced sizes, and the like. Accordingly, in the respective technical field, it has been necessary to secure high performance and reliability of a chip having a reduced size.

SUMMARY

An aspect of the present disclosure is to provide a coil electronic component in which cohesion force between an external electrode and a lead-out pattern may improve and warpage of a support substrate may be reduced, such that the coil electronic component may have improved structural stability.

According to an aspect of the present disclosure, a coil electronic component is provided, the coil electronic component including a support substrate, a coil pattern disposed on at least one surface of the support substrate, a lead-out pattern disposed on at least one surface of the support substrate and connected to the coil pattern, an encapsulant encapsulating at least portions of the support substrate, the coil pattern, and the lead-out pattern, at least one protrusion protruding from one side surface of the coil pattern, and external electrodes disposed externally on the encapsulant and connected to the lead-out pattern, and the lead-out pattern is configured to extend in a thickness direction of the support substrate and to cover a side surface of the support substrate.

The lead-out pattern, the coil pattern, and the at least one protrusion may be configured to be integrated with one another.

A plurality of the protrusions may be provided, and the plurality of protrusions may be configured to protrude from the one side surface of the coil pattern in directions opposing each other.

Protrusions of the plurality of protrusions disposed on a same plane may be disposed symmetrically to each other in a diagonal direction with reference to a central portion of the coil pattern The plurality of protrusions may further include protrusions protruding from the one side surface of the coil pattern in a direction perpendicular to the opposing directions.

A thickness of the at least one protrusion may be the same as a thickness of the coil pattern.

A thickness of the at least one protrusion may be less than a thickness of the coil pattern.

Each of the coil pattern and the at least one protrusion may include a seed layer and a first plating layer.

The coil pattern may further include a second plating layer covering the first plating layer, and may have a thickness greater than a thickness of the at least one protrusion.

The at least one protrusion may be buried in the encapsulant.

The at least one protrusion may be exposed to an external surface of the encapsulant.

An exposed surface of the protrusion may be coplanar with one external surface of the encapsulant.

An external electrode of the external electrodes may contact the lead-out pattern on a side surface of the encapsulant, and may extend from the side surface of the encapsulant to a lower surface thereof.

Each of the external electrodes may have an L-shaped form.

The external electrodes may be spaced apart from the support substrate.

According to an aspect of the present disclosure, a coil electronic component includes a support substrate, a coil pattern comprising a spiral conductor disposed on at least one surface of the support substrate, an encapsulant encapsulating at least portions of the support substrate and the coil pattern, and first and second external electrodes connected to opposite ends of the spiral conductor. The coil pattern includes at least one protrusion protruding from one side surface of the spiral conductor at a location spaced apart from the opposite ends of the spiral conductor.

The first and second external electrodes may be disposed on respective surfaces of the encapsulant opposite each other in a length direction, and the at least one protrusion may protrude from the one side surface of the spiral conductor in a width direction orthogonal to the length direction.

The coil electronic component may further include a plurality of protrusions including the at least one protrusion, and the plurality of protrusions may be configured to protrude from the one side surface of the coil pattern in directions opposing each other along the width direction.

The first and second external electrodes may be disposed on respective end surfaces of the encapsulant opposite each other in a length direction, and the at least one protrusion may extend from the one side surface of the spiral conductor towards a side surface of the encapsulant orthogonal to the end surfaces.

The coil pattern may include first and second coil spiral conductors disposed on opposing surfaces of the support substrate, and each of the first and second coil spiral conductors may include at least one protrusion protruding from one side surface thereof at a location spaced apart from opposing ends thereof.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
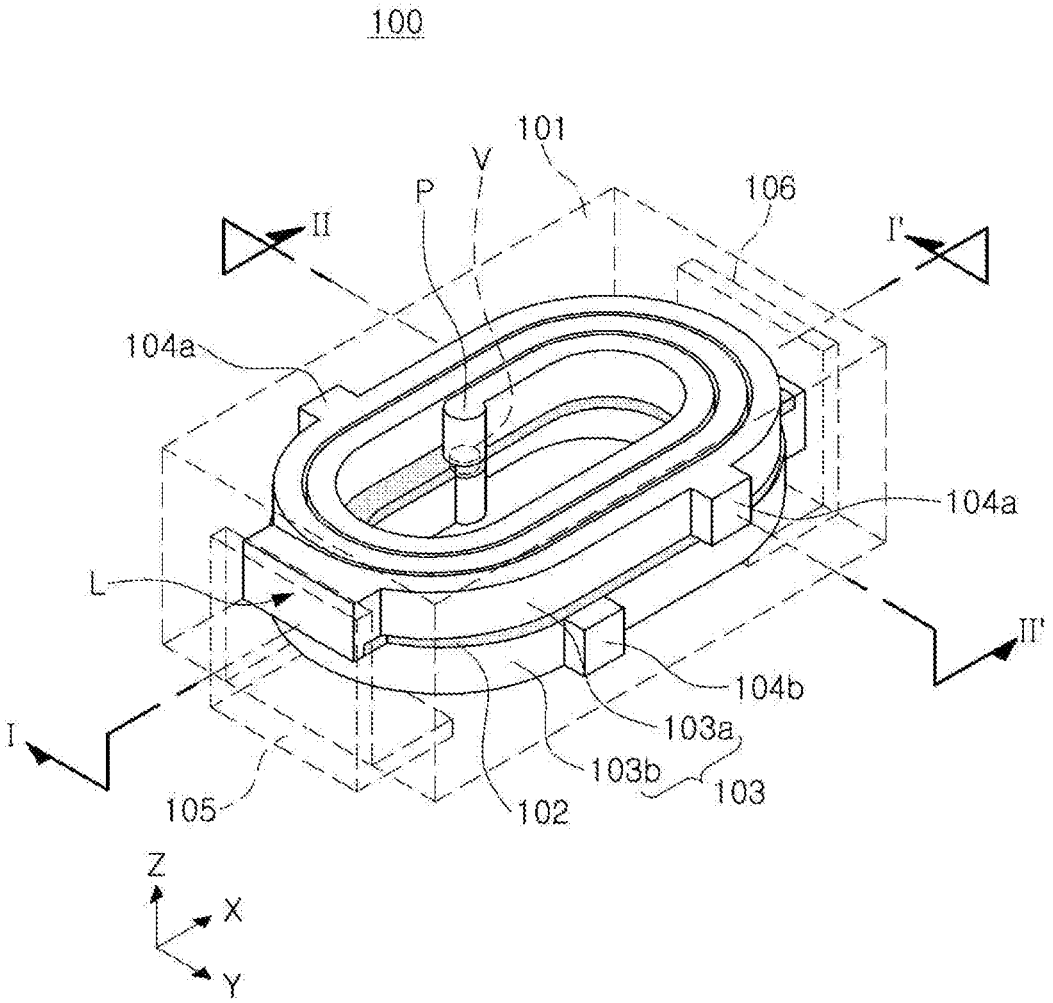
FIG. 1 is a perspective diagram illustrating a coil electronic component according to an example embodiment of the present disclosure.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art. Accordingly, shapes and sizes of the elements in the drawings can be exaggerated for clear description. Also, elements having the same function within the scope of the same concept represented in the drawing of each exemplary embodiment will be described using the same reference numeral.

Figure 2:
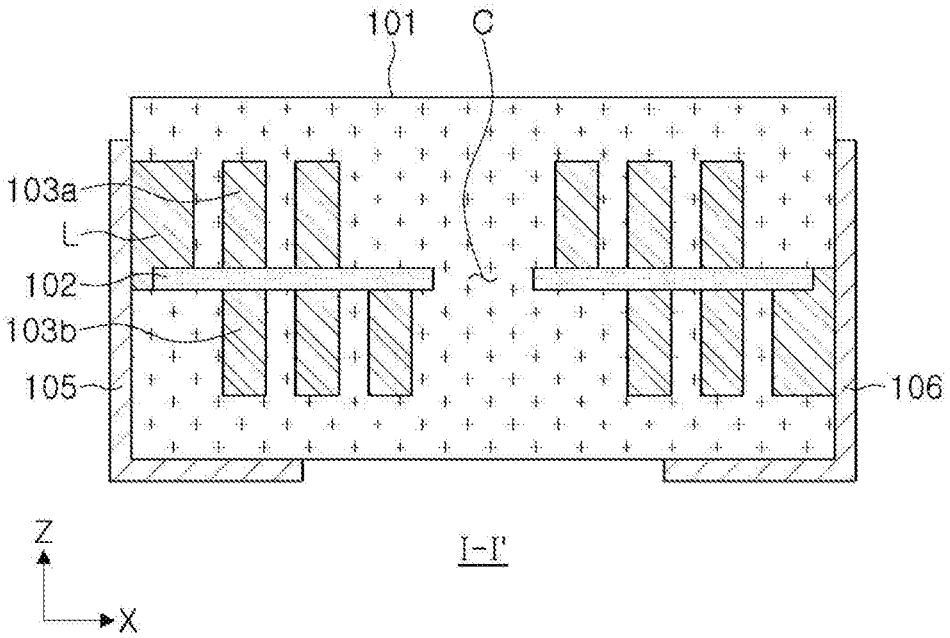
FIGS. 2 and 3 are cross-sectional diagrams illustrating a coil electronic component taken along lines I-I' and II-II' in FIG. 1, respectively.
Figure 3:
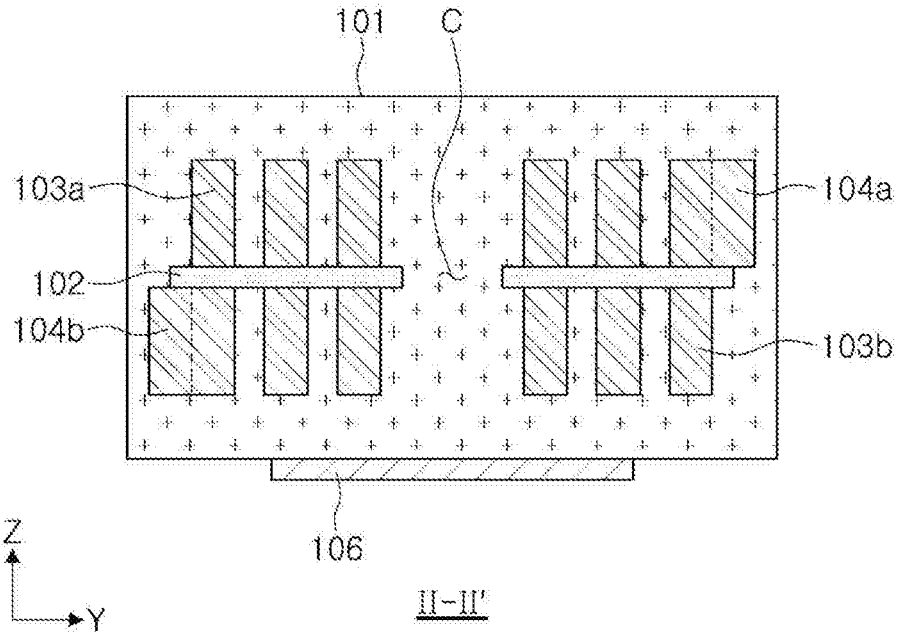

FIG. 1 is a perspective diagram illustrating a coil electronic component according to an example embodiment. FIGS. 2 and 3 are cross-sectional diagrams illustrating a coil electronic component taken along lines I-I' and II-II' in FIG. 1, respectively. FIG. 4 to FIG. 7 are diagrams illustrating portions of processes of manufacturing a coil electronic component having the structure illustrated in FIG. 1.

Referring to FIGS. 1 to 3, a coil electronic component 100 in the example embodiment may include an encapsulant 101, a support substrate 102, a coil pattern 103, a lead-out pattern L, and external electrodes 105 and 106. The lead-out pattern L may extend in a thickness direction (Z direction) of the support substrate 102 and may cover a side surface of the support substrate 102. At least one protrusion 104*a* and 104*b* protruding from one side surface of the coil pattern 103 may be provided.

The encapsulant 101 may encapsulate at least portions of the support substrate 102, the coil pattern 103, the lead-out pattern L, and other components, and may form an exterior of the coil electronic component 100. In this case, the encapsulant 101 may be configured to externally expose a partial region of the lead-out pattern L. The encapsulant 101 may include magnetic particles dispersed therein, and an insulating resin may be interposed between the magnetic particles. Surfaces of the magnetic particles may be coated with an insulating film. As the magnetic particles included in the encapsulant 101, ferrite, a metal, and the like, may be used. When the magnetic particles are implemented by a metal, the magnetic particles may be an Fe-based alloy, and the like. For example, the magnetic particles may be a nanocrystalline particle boundary alloy having a composition of Fe—Si—B—Cr, an Fe—Ni based alloy, and the like. When the magnetic particles are implemented by an Fe-based alloy, magnetic properties such as permeability may improve, but the magnetic particles may be vulnerable to electrostatic discharge (ESD). Accordingly, an additional insulation structure may be interposed between the coil pattern 103 and the magnetic particles.

The support substrate 102 may support the coil pattern 103, and may be implemented as a polypropylene glycol (PPG) substrate, a ferrite substrate or a metal-based soft magnetic substrate, and the like. As illustrated in the diagram, a through-hole C may be formed in a central portion of the support substrate 102, penetrating through the support substrate 102 between two surfaces opposing each other in a thickness direction, and the through-hole C may be filled with the encapsulant 101, thereby forming a magnetic core portion C. As described above, the lead-out pattern L may extend in a thickness direction of the support substrate 102 (e.g., a direction orthogonal to a surface of the support substrate 102 having the coil pattern 103 thereon) and may cover a side surface of the support substrate 102, and accordingly, a contact area between the lead-out pattern L and the external electrodes 105 and 106 may increase. As the contact area between the lead-out pattern L and the external electrodes 105 and 106 increases, adhesion force of the external electrodes 105 and 106 in the coil electronic component 100 may improve, and electrical properties of the coil electronic component 100, such as direct current resistance properties, may improve.

To improve adhesion force of the external electrodes 105 and 106, generally, after forming the coil pattern 103, the support substrate 102 may be processed and partially removed. Accordingly, a contact area between the encapsulant 101 and the external electrodes 105 and 106 may increase. However, depending on a process, warpage of the support substrate 102 may occur. In the example embodiment, a hole may be formed in the support substrate 102 before forming the coil pattern 103, and the lead-out pattern L may be formed to fill the hole. To this end, a position of a lead-in wire for forming the coil pattern 103 may be altered.

The coil pattern 103 may have a spiral structure forming one or more turns, and may be formed on at least one surface of the support substrate 102. The diagram illustrates the example embodiment in which the coil pattern 103 includes first and second coil patterns 103*a* and 103*b* disposed on two surfaces of the support substrate 102 opposing each other in the thickness direction. In this case, each of the first and second coil patterns 103*a* and 103*b* may include a pad region P, and the first and second coil patterns 103*a* and 103*b* may be connected to each other by a via V penetrating the support substrate 102 between the pad regions P of the coil patterns 103*a* and 103*b*. The coil pattern 103 may be formed through a plating process used in the respective technical field, such as a pattern plating process, an anisotropic plating process, an isotropic plating process, or the like, and may be configured to have a multilayer structure formed using a plurality of processes among the above-mentioned processes.

The external electrodes 105 and 106 may be disposed externally on the encapsulant 101 and may be connected to the lead-out pattern L. The external electrodes 105 and 106 may be formed using a paste including a metal having high electrical conductivity, and the paste may be a conductive paste including one of nickel (Ni), copper (Cu), tin (Sn), or silver (Ag), or alloys thereof, for example. Each of the external electrodes 105 and 106 may further include a plating layer (not illustrated) formed thereon. In this case, the plating layer may include one or more elements selected from a group consisting of nickel (Ni), copper (Cu), and tin (Sn). For example, a nickel (Ni) plating layer and a tin (Sn) plating layer may be formed in sequential order.

The external electrodes 105 and 106 may be connected to the lead-out pattern L on a side surface of the encapsulant 101, and may extend from a respective side surface of the encapsulant 101 to a lower surface thereof. As an example configuration thereof, each of the external electrodes 105 and 106 may be configured to have an L-shaped form. When the external electrodes 105 and 106 have an L-shaped form, a thickness of the coil electronic component 100 may be reduced, such that a size of the coil electronic component 100 may be reduced, but adhesion force of the external electrodes 105 and 106 may decrease in the coil electronic component 100. As described above, in the example embodiment, the lead-out pattern L may extend in a thickness direction of the support substrate 102 and may cover a side surface of the support substrate 102, thereby increasing a contact area between the lead-out pattern L and the external electrodes 105 and 106. Accordingly, adhesion force of the external electrodes 105 and 106 may improve, and the support substrate 102 may not be in contact with the external electrodes 105 and 106.

The lead-out pattern L may be disposed in an outermost region of the coil pattern 103, may provide a connection path with the external electrodes 105 and 106, and may be integrated with the coil pattern 103. The lead-out pattern L may extend in a thickness direction of the support substrate 102, and may cover side a surface of the support substrate 102, such that the support substrate 102 may be spaced apart from the external electrodes 105 and 106 by the lead-out pattern L extending into the space therebetween. In this case, as illustrated in the diagram, the lead-out pattern L may have a width greater than a width of the coil pattern 103 to be connected to the external electrodes 105 and 106. The width may be a width taken in the X direction in FIG. 1. The lead-out pattern L may further have a thickness greater than a thickness of the coil pattern 103, the thickness being taken in the Z direction in FIG. 1.

The protrusions 104*a* and 104*b* may be configured to protrude from one side surface of the coil pattern 103. In the diagram, the protrusion disposed in an upper portion of the coil pattern 103 above the support substrate 102 is indicated as 104*a*, and the protrusion disposed in a lower portion of the coil pattern 103 below the support substrate 102 is indicated as 104*b*. The protrusions 104*a* and 104*b* may be configured as portions of a plating lead-in wire for forming the coil pattern 103, and may remain in the encapsulant 101 and may improve cohesion force between the coil pattern 103 and the encapsulant 101. In this case, the lead-out pattern L, the coil pattern 103, and the protrusions 104*a* and 104*b* may be integrated with one another, and an example embodiment thereof will be described in greater detail later. A thickness of each of the protrusions 104*a* and 104*b* may be the same as a thickness of the coil pattern 103 (e.g., measured in the thickness direction Z of FIG. 1).

Figure 8:
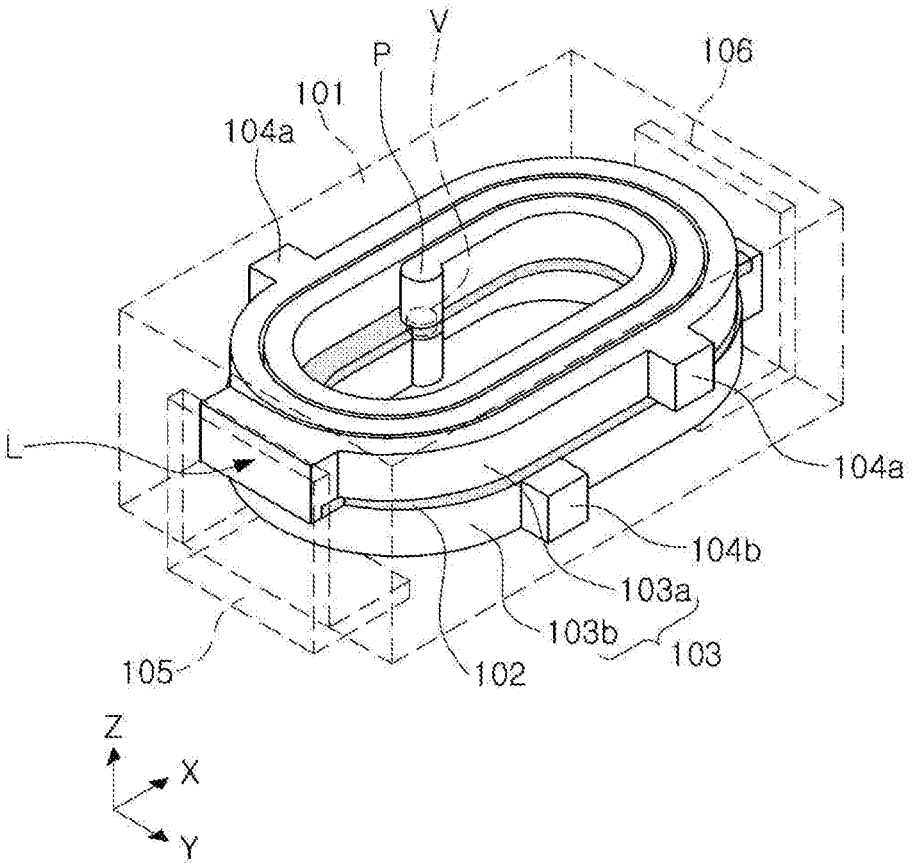
FIGS. 8 and 9 are perspective diagrams illustrating coil electronic components according to modified example embodiments.

As illustrated in the diagram, the protrusions 104*a* and 104*b* may be configured to be buried in the encapsulant 101, and the protrusions 104*a* and 104*b* may be buried in the encapsulant 101 by configuring the encapsulant 101 to cover the protrusions 104*a* and 104*b* cut-out by a dicing process. Alternatively, as illustrated in the modified example in FIG. 8, the protrusions 104*a* and 104*b* may also be configured to be exposed to a surface of the encapsulant 101. In this case, the exposed surface of the protrusions 104*a* and 104*b* and one external surface of the encapsulant 101 may be coplanar with each other.

Referring to FIG. 1 and other diagrams, a plurality of the protrusions 104*a* and 104*b* may be provided, and in this case, the plurality of protrusions 104*a* and 104*b* may include protrusions protruding from the coil pattern 103 in both directions (Y direction in FIG. 1) opposing each other. As illustrated in the diagram, the protrusions (the protrusions 104*a* or the protrusions 104*b*) disposed on the same plane may be configured to be symmetrical to each other in a diagonal direction with reference to a central portion of the coil pattern (the coil pattern 103*a* or the coil pattern 103*b*). Alternatively, the protrusions (the protrusions 104*a* or the protrusions 104*b*) disposed on the same plane may be disposed in the same straight line in parallel to a width direction (Y direction in FIG. 1) of the encapsulant 101.

Figure 9:
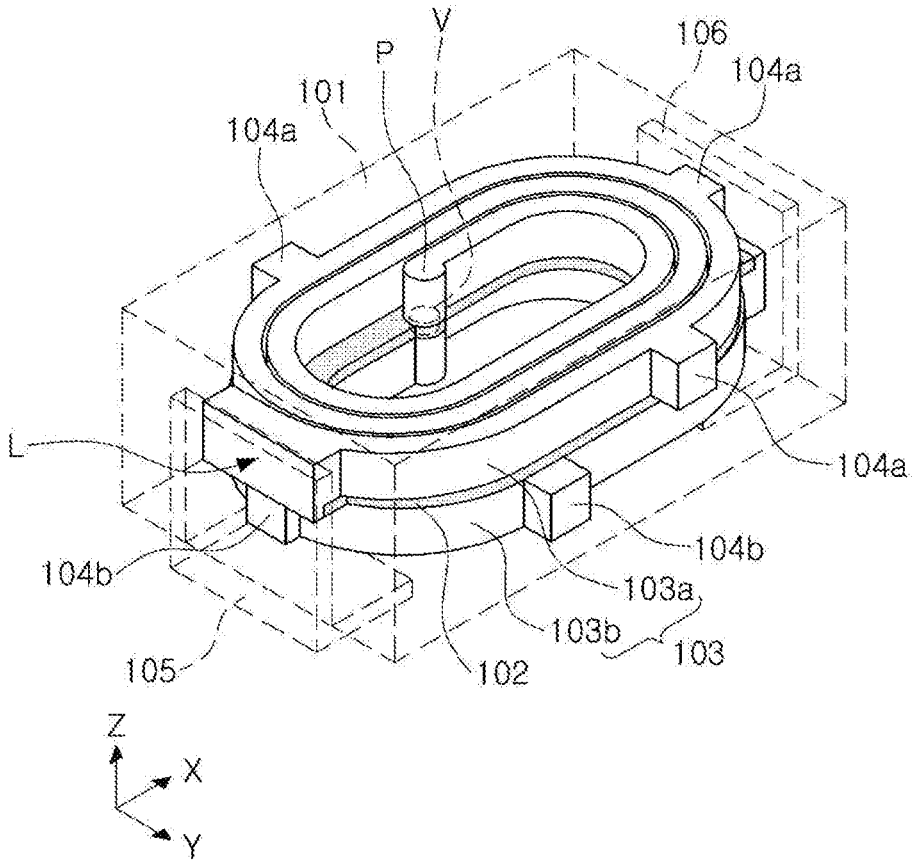

The arrangement position of the protrusions 104*a* and 104*b* may be determined depending on a position of a plating lead-in wire for forming the coil pattern 103. In this case, as illustrated in the modified example in FIG. 9, the plurality of protrusions 104*a* and 104*b* may include protrusions protruding from the coil pattern 103 in both a first direction (X direction) and a second direction (Y direction) perpendicular to the first direction.

Figure 4:
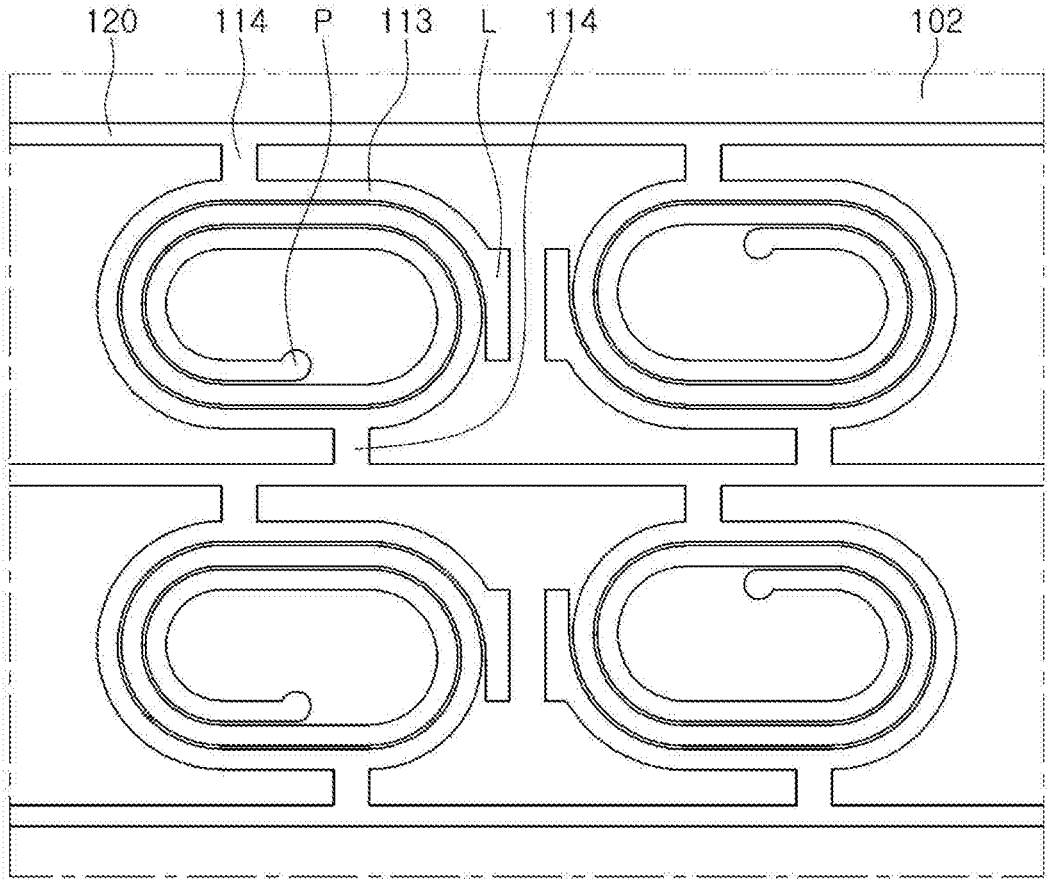
FIGS. 4, 5, 6, and 7 are diagrams illustrating portions of processes for manufacturing a coil electronic component having the structure illustrated in FIG. 1.
Figure 5:
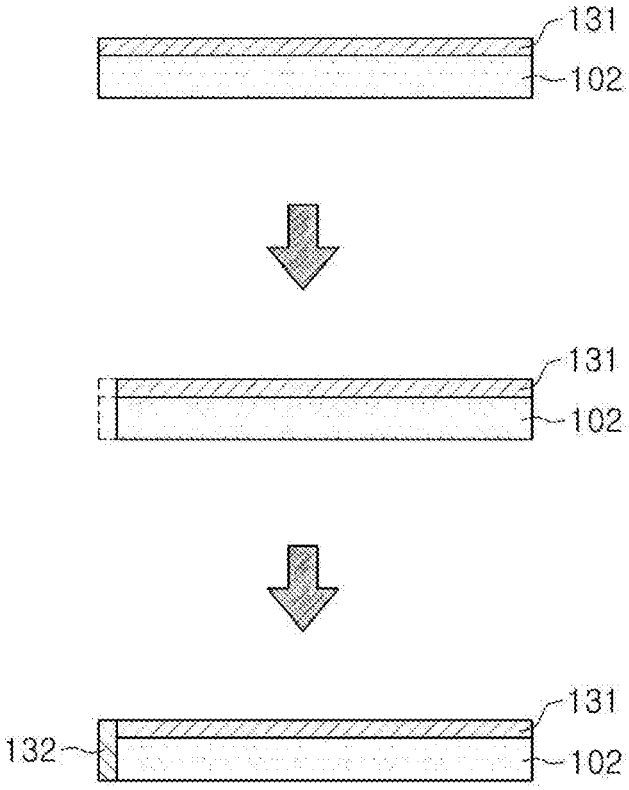

Referring to FIGS. 4 to 7, an example of a process for forming protrusions 104*a* and 104*b* and a specific structure thereof will be described. As illustrated in FIGS. 4 and 5, a coil pattern 113 may be formed on a support substrate 102 by a plating process. To this end, a seed layer 131 may be provided on the support substrate 102. The seed layer 131 may be configured as a copper foil, and a mask pattern such as a plating resist pattern may be formed on the seed layer 131 to form a plating layer in a desired form.

The coil pattern 113 may be formed by an electroplating process by applying an electrical signal to the seed layer 131. To this end, a plating lead-in wire 120 may be formed on the support substrate 102. In this case, a protrusion 114 may connect the coil pattern 113 to a portion of the plating lead-in wire 120, and may remain in the coil pattern 113 by a subsequent dicing process for individualizing the components in component unit. In the example embodiment, a hole may be formed by removing the seed layer 131 and the support substrate 102 such that a lead-out pattern L may cover a side surface of the support substrate 102 before the electroplating process (see a diagram in the middle in FIG. 5). A seed layer 132 may be formed on a wall of the hole using an electroless plating process, and the seed layer 132 may work as a seed for plating the lead-out pattern L.

Generally, the plating lead-in wire 120 may be disposed in a direction of the lead-out pattern L and may be connected to the lead-out pattern L. In this case, it may be difficult to form the lead-out pattern L having a shape as in the example illustrated in the diagram during plating of the coil pattern 113. That is because it may be difficult to form a hole in the support substrate 102 in a region in which the plating lead-in wire 120 is formed. In the example embodiment, the plating lead-in wire 120 may thus be configured to be disposed in a direction in which the lead-out pattern L is not disposed, and accordingly, the process for forming the lead-out pattern L penetrating into the support substrate 102 as illustrated in FIGS. 5 and 6 may be performed.

In the example embodiment illustrated in FIG. 4, the plating lead-in wire 120 is disposed in across a length direction (in the orientation shown in the figure), but an example embodiment thereof is not limited thereto. The plating lead-in wire 120 may also be disposed in a width direction, or both of plating lead-in wires disposed in a length direction and a width direction may be provided. When the plating lead-in wire disposed in a width direction is used, the protrusions 104*a* and 104*b* illustrated in FIG. 9 may be obtained.

Figure 6:
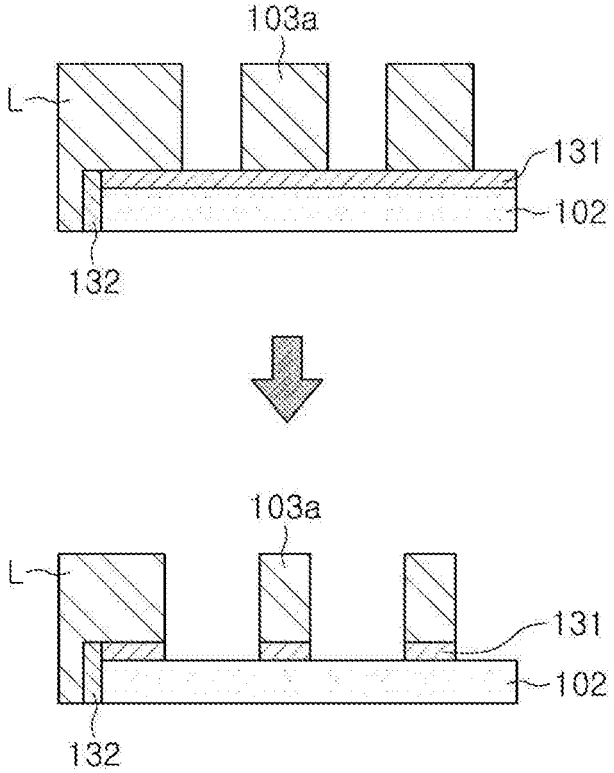
Figure 7:
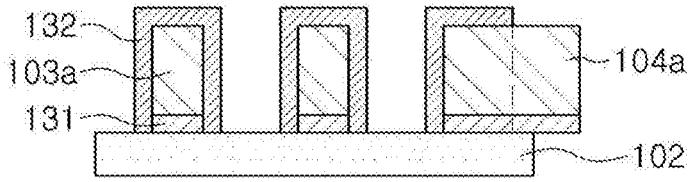

Referring to FIGS. 6 and 7 along with FIG. 5, with respect to the processes for forming the lead-out pattern L, the coil pattern 103*a*, and the protrusion 104*a*, the lead-out pattern L and the coil pattern 103*a* may be formed on the seed layers 131 and 132 by an electroplating process (e.g., as shown in the first diagram in FIG. 6). In this process, the protrusion 104*a* may also be formed. In this case, the lead-out pattern L and the coil pattern 103*a* formed by an electroplating process may be configured as a pattern plating layer (a first plating layer), and may include elements such as Cu, Ag, Pt, Ni, and the like. A mask pattern partially covering the support substrate 102 may be provided to form the lead-out pattern L and the coil pattern 103*a* by a pattern plating process. As the seed layer 131 is formed on an overall surface of the support substrate 102, the seed layer 131 may need to be etched in accordance with a shape of the coil pattern 103*a*. When the seed layer 131 is etched, the lead-out pattern L and the coil pattern 103*a* may also be etched. The second diagram in FIG. 6 illustrates an example in which the etching process is completed, and by the etching process, the seed layer 131 and the coil pattern 103*a* may have the same width.

As described above, each of the lead-out pattern L, the coil pattern 103*a*, and the protrusion 104*a* may include the seed layer 131 and the pattern plating layer (the first plating layer). Also, the coil pattern 103*a* may include a second plating layer 132 covering the first plating layer as in the example illustrated in FIG. 7. Likewise, the lead-out pattern L may also include the first plating layer 131 and the second plating layer 132. The protrusion 104*a* may not include the second plating layer 132, and accordingly, the protrusion 104*a* may have a thickness less than a thickness of the coil pattern 103*a*. Accordingly, as the coil pattern 103*a* further includes the second plating layer 132 covering the first plating layer 103*a* (in FIG. 7), the coil pattern 103*a* may have a thickness greater than a thickness of the protrusion 104*a*. As described above, the protrusion 104*a* may be a remaining region of the plating lead-in wire 120, and may not be a portion of the coil pattern 103*a* (e.g., may not be a functional region of the coil electronic component 100 contributing to inductance), and it may not be necessary to increase an aspect ratio thereof. Thus, when the second plating layer 132 is formed, a plating resist pattern, and the like, may be formed on an upper surface of the protrusion 104*a* such that further growth of the protrusion 104*a* may be prevented, and degradation of electrical and magnetic properties of the coil electronic component 100 caused by excessively increasing a volume of the protrusion 104*a* may be prevented.

According to the aforementioned example embodiments, in the coil electronic component, cohesion force between the external electrode and the lead-out pattern may improve, and warpage of the support substrate may be reduced such that structural stability of the coil electronic component may improve.

While the exemplary embodiments have been shown and described above, it will be apparent to those skilled in the art that modifications and variations could be made without departing from the scope of the present invention as defined by the appended claims.

What is claimed is:

1. A coil electronic component, comprising:

a support substrate;

a coil pattern disposed on at least one surface of the support substrate;

a lead-out pattern disposed on at least one surface of the support substrate and connected to the coil pattern;

an encapsulant encapsulating at least portions of the support substrate, the coil pattern, and the lead-out pattern;

at least one protrusion protruding from one side surface of the coil pattern; and an external electrode disposed on a mounting surface of the encapsulant and connected to the lead-out pattern, wherein the lead-out pattern extends in a thickness direction of the support substrate to cover a side surface of the support substrate, wherein the encapsulant includes an upper surface opposite the mounting surface in the thickness direction and a side surface connecting the mounting and upper surfaces, and wherein the at least one protrusion is exposed to the side surface of the encapsulant and spaced apart from the mounting and upper surfaces in the thickness direction.

2. The coil electronic component of claim 1, wherein the lead-out pattern, the coil pattern, and the at least one protrusion are integrated with one another.

3. The coil electronic component of claim 1, further comprising a plurality of protrusions including the at least one protrusion, wherein the plurality of protrusions protrude from the one side surface of the coil pattern in directions opposing each other.

4. The coil electronic component of claim 3, wherein protrusions of the plurality of protrusions disposed on a same plane are disposed symmetrically to each other in a diagonal direction with reference to a central portion of the coil pattern.

5. The coil electronic component of claim 3, wherein the plurality of protrusions further include a protrusion protruding from the one side surface of the coil pattern in a direction perpendicular to the opposing directions.

6. The coil electronic component of claim 1, wherein a thickness of the at least one protrusion is the same as a thickness of the coil pattern.

7. The coil electronic component of claim 1, wherein a thickness of the at least one protrusion is less than a thickness of the coil pattern.

8. The coil electronic component of claim 1, wherein each of the coil pattern and the at least one protrusion includes a seed layer and a first plating layer.

9. The coil electronic component of claim 8, wherein the coil pattern further includes a second plating layer covering the first plating layer, and has a thickness greater than a thickness of the at least one protrusion.

10. The coil electronic component of claim 1, wherein the at least one protrusion is buried in the encapsulant.

11. The coil electronic component of claim 1, wherein an exposed surface of the protrusion is coplanar with one external surface of the encapsulant.

12. The coil electronic component of claim 1, wherein the external electrode contacts the lead-out pattern on a side surface of the encapsulant, and extends from the side surface of the encapsulant to a lower surface thereof.

13. The coil electronic component of claim 12, wherein the external electrode has an L-shaped form.

14. The coil electronic component of claim 1, wherein the external electrode is spaced apart from the support substrate.

15. A coil electronic component comprising:

a support substrate;

a coil pattern comprising a spiral conductor disposed on at least one surface of the support substrate in a thickness direction;

an encapsulant encapsulating at least portions of the support substrate and the coil pattern, the encapsulant having a mounting surface and an upper surface opposing each other in the thickness direction and a side surface connecting the mounting and upper surfaces; and first and second external electrodes disposed on the mounting surface and respectively connected to opposite ends of the spiral conductor, wherein the coil pattern includes at least one protrusion protruding from one side surface of the spiral conductor at a location spaced apart from the opposite ends of the spiral conductor, and wherein the at least one protrusion is exposed to the side surface of the encapsulant and spaced apart from the mounting and upper surfaces in the thickness direction.

16. The coil electronic component of claim 15, wherein the first and second external electrodes are disposed on respective surfaces of the encapsulant opposite each other in a length direction, and the at least one protrusion protrudes from the one side surface of the spiral conductor in a width direction orthogonal to the length direction.

17. The coil electronic component of claim 16, further comprising a plurality of protrusions including the at least one protrusion, wherein the plurality of protrusions are configured to protrude from the one side surface of the coil pattern in directions opposing each other along the width direction.

18. The coil electronic component of claim 15, wherein the first and second external electrodes are disposed on respective end surfaces of the encapsulant opposite each other in a length direction, the at least one protrusion extends from the one side surface of the spiral conductor towards a side surface of the encapsulant orthogonal to the end surfaces.

19. The coil electronic component of claim 15, wherein the coil pattern includes first and second coil spiral conductors disposed on opposing surfaces of the support substrate, and each of the first and second coil spiral conductors includes at least one protrusion protruding from one side surface thereof at a location spaced apart from opposing ends thereof.

20. The coil electronic component of claim 15, wherein the coil pattern includes a lead-out portion extending between one opposite end of the spiral conductor and the first external electrode and between the support substrate and the first external electrode.

* * * * *